US011043179B1

(12) United States Patent
Xu et al.

(10) Patent No.: US 11,043,179 B1
(45) Date of Patent: Jun. 22, 2021

(54) GOA DEVICE AND GATE DRIVE CIRCUIT

(71) Applicant: SHENZHEN CHINA STAR OPTOELECTRONICS SEMICONDUCTOR DISPLAY TECHNOLOGY CO., LTD., Guangdong (CN)

(72) Inventors: Zhida Xu, Guangdong (CN); Xiaohui Yao, Guangdong (CN); Ilgon Kim, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/960,605

(22) PCT Filed: May 18, 2020

(86) PCT No.: PCT/CN2020/090756

§ 371 (c)(1),
(2) Date: Jul. 8, 2020

(30) Foreign Application Priority Data

Apr. 30, 2020 (CN) ..... 202010367315.5

(51) Int. Cl.
*G09G 3/36* (2006.01)
*G09G 3/20* (2006.01)

(52) U.S. Cl.
CPC ..... *G09G 3/3677* (2013.01); *G09G 3/2092* (2013.01)

(58) Field of Classification Search
CPC ..... G09G 3/3677; G09G 3/3676
See application file for complete search history.

(56) References Cited

U.S. PATENT DOCUMENTS

2019/0019442 A1* 1/2019 Xu ..... G09G 3/3677
2019/0043437 A1* 2/2019 Hao ..... G09G 3/3677

* cited by examiner

*Primary Examiner* — Sepehr Azari

(57) ABSTRACT

The present disclosure provides a GOA device and a gate drive circuit. The GOA device includes at least two GOA units in cascade. The present disclosure connects the input terminal of the pull-up control circuit to the start signal of the n−7-th stage, the control node (Qn) of the n-th GOA unit is thus pulled up to the first high potential and the bootstrap capacitor is charged. The control node (Qn) is charged 7 stages in advance, which resolves the technical problem of insufficient charging of the high-resolution high-refresh rate display panel in the related art.

18 Claims, 2 Drawing Sheets

GOA DEVICE AND GATE DRIVE CIRCUIT

BACKGROUND

1. Field of the Invention

The present disclosure relates to the field of display technology, more particularly, to a gate drive on array (GOA) device and a gate drive circuit.

2. Description of the Related Art

The GOA technology integrates the scan line drive circuit onto the array substrate of the liquid crystal panel, so as to reduce the production cost in the aspects of material and manufacturing processes.

For the display panel with high resolution and high frequency (such as 120 HZ), the capacitive loads of the scan lines are heavier due to the shorter charging time, thus resulting in a more serious distortion of the gate pulse signals. The value of the falling time of the output signals of the gate signal lines is larger, thus causing a high risk of mischarging. In addition, when a display panel is operated in this state for a long time, the electrical properties of the thin film transistors will shift.

Therefore, there is a need to provide a gate drive circuit to resolve the above technique problems.

SUMMARY

The present disclosure provides a GOA device and a gate drive circuit to resolve the technical problem of insufficient charging of the GOA device of the display panel in the related art.

The present disclosure provides a GOA device. The GOA device comprises at least two GOA units in cascade. An n-th GOA unit is configured to output a gate drive signal to an n-th horizontal scan line. The n-th GOA unit comprises a pull-up control circuit, a bootstrap capacitor, a pull-up unit, a pull-down unit and a pull-down hold unit.

The pull-up control circuit receives a start signal of an n−7-th stage during a first stage, so that a control node (Qn) of the n-th GOA unit is pulled up to a first high potential and the bootstrap capacitor is charged.

The bootstrap capacitor maintains the control node (Qn) of the n-th GOA unit at the first high potential during a second stage.

The pull-up unit outputs the gate drive signal to a gate signal terminal (Gn) of the n-th GOA unit according to a clock signal and the first high potential of the control node (Qn) of the n-th GOA unit.

The pull-down unit pulls a potential of the control node (Qn) of the n-th GOA unit to a first DC low level, and pulls a potential of the gate signal terminal (Gn) of the n-th GOA unit to a second DC low level during a third stage.

The pull-down hold unit maintains the control node (Qn) of the n-th GOA unit at the first DC low level, and maintains the potential of the gate signal terminal (Gn) of the n-th GOA unit at the second DC low level during a fourth stage.

A duration of the clock signal at a high level is longer than a duration of the clock signal at a low level.

In the GOA device according to the present disclosure, the pull-up control circuit is connected to a stage signal terminal (STn−7) of the n−7-th GOA unit and the control node (Qn) of the n-th GOA unit.

The pull-up control circuit receives the start signal from the stage signal terminal (STn−7) of the n−7-th GOA unit, and allows the control node (Qn) of the n-th GOA unit to be at the first high potential according to the received start signal of the stage signal terminal (STn−7) of the n−7-th GOA unit during the first stage.

In the GOA device according to the present disclosure, the pull-up control circuit comprises an eleventh TFT. A gate and a source of the eleventh TFT (T11) are connected to the stage signal terminal (STn−7) of the n-th GOA unit, and a drain of the eleventh TFT (T11) is connected to the control node (Qn) of the n-th GOA unit.

In the GOA device according to the present disclosure, the bootstrap capacitor is connected to the control node (Qn) of the n-th GOA unit, the gate signal terminal (Gn) of the n-th GOA unit, the pull-down hold unit, and the pull-up unit. A first terminal of the bootstrap capacitor is connected to the control node (Qn) of the n-th GOA unit and the pull-up unit, a second terminal of the bootstrap capacitor is connected to the gate signal terminal (Gn) of the n-th GOA unit and the pull-down hold unit.

In the GOA device according to the present disclosure, the pull-up unit is connected to the control node (Qn) of the n-th GOA unit, a clock signal terminal (CK), a stage signal terminal (STn) of the n-th GOA unit and the gate signal terminal (Gn) of the n-th stage. The clock signal terminal (CK) is configured to provide the clock signal. The potential of the control node (Qn) of the n-th GOA unit is configured to control thin film transistors in the pull-up unit to turn on and turn off.

In the GOA device according to the present disclosure, the pull-up unit comprises a twenty-first TFT (T21) and a twenty-second TFT (T22). A gate of the twenty-first TFT (T21) is connected to the control node (Qn) of the n-th GOA unit, a source of the twenty-first TFT (T21) is connected to the clock signal terminal (CK), a drain of the twenty-first TFT (T21) is connected to the gate signal terminal (Gn) of the n-th stage. A gate of the twenty-second TFT (T22) is connected to the control node (Qn) of the n-th GOA unit, a source of the twenty-second TFT (T22) is connected to the clock signal terminal (CK), a drain of the twenty-second TFT (T22) is connected to the stage signal terminal (STn) of the n-th GOA unit.

In the GOA device according to the present disclosure, the pull-down unit is connected to the control node (Qn) of the n-th GOA unit, the gate signal terminal (Gn) of the n-th GOA unit, a gate signal terminal (Gn+6) of an n+6-th GOA unit, a gate signal terminal (Gn+8) of an n+8-th GOA unit, a first DC low level terminal (VSSQ), and a second DC low level terminal (VSSG). The first DC low level terminal (VSSQ) providing the first DC low level, and the second DC low level terminal (VSSG) providing the second DC low level. The third stage starting when the gate signal terminal (Gn+6) of the n+6-th stage GOA unit or/and the gate signal terminal (Gn+8) of the n+8-th stage GOA unit is at the high level.

In the GOA device according to the present disclosure, the pull-down unit comprises a thirty-first TFT (T31) and a forty-first TFT (T41). A source of the thirty-first TFT (T31) is connected to the gate signal terminal (Gn) of the n-th stage GOA unit, a source of the forty-first TFT (T41) is connected to the control node (Qn) of the n-th GOA unit. The thirty-first TFT (T31) is connected to the second DC low level terminal (VSSG), and a drain of the forty-first TFT (T41) is connected to the first DC low level terminal (VSSQ). A gate of the thirty-first TFT (T31) is connected to the gate signal terminal (Gn+6) of the n+6-th GOA unit, and a gate of the forty-first TFT (T41) is connected to the gate signal terminal (Gn+8) of the n+8-th GOA unit.

In the GOA device according to the present disclosure, the pull-down hold unit comprises a first pull-down hold sub-unit and a second pull-down hold sub-unit. The first pull-down hold sub-unit is connected to a first high-voltage signal, the control node (Qn) of the n-th GOA unit, the gate signal terminal (Gn) of the n-th GOA unit, a first DC low level terminal (VSSQ), and a second DC low level terminal (VSSG). The second pull-down hold sub-unit is connected to a second high-voltage signal, the control node (Qn) of the n-th GOA unit, the gate signal terminal (Gn) of the n-th GOA unit, the first DC low level terminal (VSSQ), and the second DC low level terminal (VSSG).

The present disclosure further provides a gate drive circuit comprising a GOA device. The GOA device comprises at least two GOA units in cascade. An n-th GOA unit is configured to output a gate drive signal to an n-th horizontal scan line. The n-th GOA unit comprises a pull-up control circuit, a bootstrap capacitor, a pull-up unit, a pull-down unit and a pull-down hold unit.

The pull-up control circuit receives a start signal of an n−7-th stage during a first stage, so that a control node (Qn) of the n-th GOA unit is pulled up to a first high potential and the bootstrap capacitor is charged.

The bootstrap capacitor maintains the control node (Qn) of the n-th GOA unit at the first high potential during a second stage.

The pull-up unit outputs the gate drive signal to a gate signal terminal (Gn) of the n-th GOA unit according to a clock signal and the first high potential of the control node (Qn) of the n-th GOA unit.

The pull-down unit pulls a potential of the control node (Qn) of the n-th GOA unit to a first DC low level, and pulls a potential of the gate signal terminal (Gn) of the n-th GOA unit to a second DC low level during a third stage.

The pull-down hold unit maintains the control node (Qn) of the n-th GOA unit at the first DC low level, and maintains the potential of the gate signal terminal (Gn) of the n-th GOA unit at the second DC low level during a fourth stage.

A duration of the clock signal at a high level is longer than a duration of the clock signal at a low level.

In the gate drive circuit according to the present disclosure, the pull-up control circuit is connected to a stage signal terminal (STn−7) of the n−7-th GOA unit and the control node (Qn) of the n-th GOA unit.

The pull-up control circuit receives the start signal from the stage signal terminal (STn−7) of the n−7-th GOA unit, and allows the control node (Qn) of the n-th GOA unit to be at the first high potential according to the received start signal of the stage signal terminal (STn−7) of the n−7-th GOA unit during the first stage.

In the gate drive circuit according to the present disclosure, the pull-up control circuit comprises an eleventh TFT. A gate and a source of the eleventh TFT (T11) are connected to the stage signal terminal (STn−7) of the n-th GOA unit, and a drain of the eleventh TFT (T11) is connected to the control node (Qn) of the n-th GOA unit.

In the gate drive circuit according to the present disclosure, the bootstrap capacitor is connected to the control node (Qn) of the n-th GOA unit, the gate signal terminal (Gn) of the n-th GOA unit, the pull-down hold unit, and the pull-up unit. A first terminal of the bootstrap capacitor is connected to the control node (Qn) of the n-th GOA unit and the pull-up unit, a second terminal of the bootstrap capacitor is connected to the gate signal terminal (Gn) of the n-th GOA unit and the pull-down hold unit.

In the gate drive circuit according to the present disclosure, the pull-up unit is connected to the control node (Qn) of the n-th GOA unit, a clock signal terminal (CK), a stage signal terminal (STn) of the n-th GOA unit and the gate signal terminal (Gn) of the n-th stage. The clock signal terminal (CK) is configured to provide the clock signal. The potential of the control node (Qn) of the n-th GOA unit is configured to control thin film transistors in the pull-up unit to turn on and turn off.

In the gate drive circuit according to the present disclosure, the pull-up unit comprises a twenty-first TFT (T21) and a twenty-second TFT (T22). A gate of the twenty-first TFT (T21) is connected to the control node (Qn) of the n-th GOA unit, a source of the twenty-first TFT (T21) is connected to the clock signal terminal (CK), a drain of the twenty-first TFT (T21) is connected to the gate signal terminal (Gn) of the n-th stage. A gate of the twenty-second TFT (T22) is connected to the control node (Qn) of the n-th GOA unit, a source of the twenty-second TFT (T22) is connected to the clock signal terminal (CK), a drain of the twenty-second TFT (T22) is connected to the stage signal terminal (STn) of the n-th GOA unit.

In the gate drive circuit according to the present disclosure, the pull-down unit is connected to the control node (Qn) of the n-th GOA unit, the gate signal terminal (Gn) of the n-th GOA unit, a gate signal terminal (Gn+6) of an n+6-th GOA unit, a gate signal terminal (Gn+8) of an n+8-th GOA unit, a first DC low level terminal (VSSQ), and a second DC low level terminal (VSSG). The first DC low level terminal (VSSQ) providing the first DC low level, and the second DC low level terminal (VSSG) providing the second DC low level. The third stage starting when the gate signal terminal (Gn+6) of the n+6-th stage GOA unit or/and the gate signal terminal (Gn+8) of the n+8-th stage GOA unit is at the high level.

In the gate drive circuit according to the present disclosure, the pull-down unit comprises a thirty-first TFT (T31) and a forty-first TFT (T41). A source of the thirty-first TFT (T31) is connected to the gate signal terminal (Gn) of the n-th stage GOA unit, a source of the forty-first TFT (T41) is connected to the control node (Qn) of the n-th GOA unit. The thirty-first TFT (T31) is connected to the second DC low level terminal (VSSG), and a drain of the forty-first TFT (T41) is connected to the first DC low level terminal (VSSQ). A gate of the thirty-first TFT (T31) is connected to the gate signal terminal (Gn+6) of the n+6-th GOA unit, and a gate of the forty-first TFT (T41) is connected to the gate signal terminal (Gn+8) of the n+8-th GOA unit.

In the gate drive circuit according to the present disclosure, the pull-down hold unit comprises a first pull-down hold sub-unit and a second pull-down hold sub-unit. The first pull-down hold sub-unit is connected to a first high-voltage signal, the control node (Qn) of the n-th GOA unit, the gate signal terminal (Gn) of the n-th GOA unit, a first DC low level terminal (VSSQ), and a second DC low level terminal (VSSG). The second pull-down hold sub-unit is connected to a second high-voltage signal, the control node (Qn) of the n-th GOA unit, the gate signal terminal (Gn) of the n-th GOA unit, the first DC low level terminal (VSSQ), and the second DC low level terminal (VSSG).

The present disclosure connects the input terminal of the pull-up control circuit to the start signal of the n−7-th stage, the control node (Qn) of the n-th GOA unit is thus pulled up to the first high potential and the bootstrap capacitor is charged. The control node (Qn) is charged 7 stages in advance, which resolves the technical problem of insufficient charging of the high-resolution high-refresh rate display panel in the related art.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

For the purpose of description rather than limitation, the following provides such specific details as a specific system structure, interface, and technology for a thorough understanding of the application. However, it is understandable by persons skilled in the art that the application can also be implemented in other embodiments not providing such specific details. In other cases, details of a well-known apparatus, circuit and method are omitted to avoid hindering the description of the application by unnecessary details.

For the display panel with high resolution and high frequency (such as 120 HZ), the capacitive loads of the scan lines are heavier due to the shorter charging time, thus resulting in a more serious distortion of the gate pulse signals. The value of the falling time of the output signals of the gate signal lines is larger, thus causing a high risk of mischarging. In addition, when a display panel is operated in this state for a long time, the electrical properties of the thin film transistors will shift. The present disclosure provides the following technical solutions based on the above technical issues.

Figure 1:
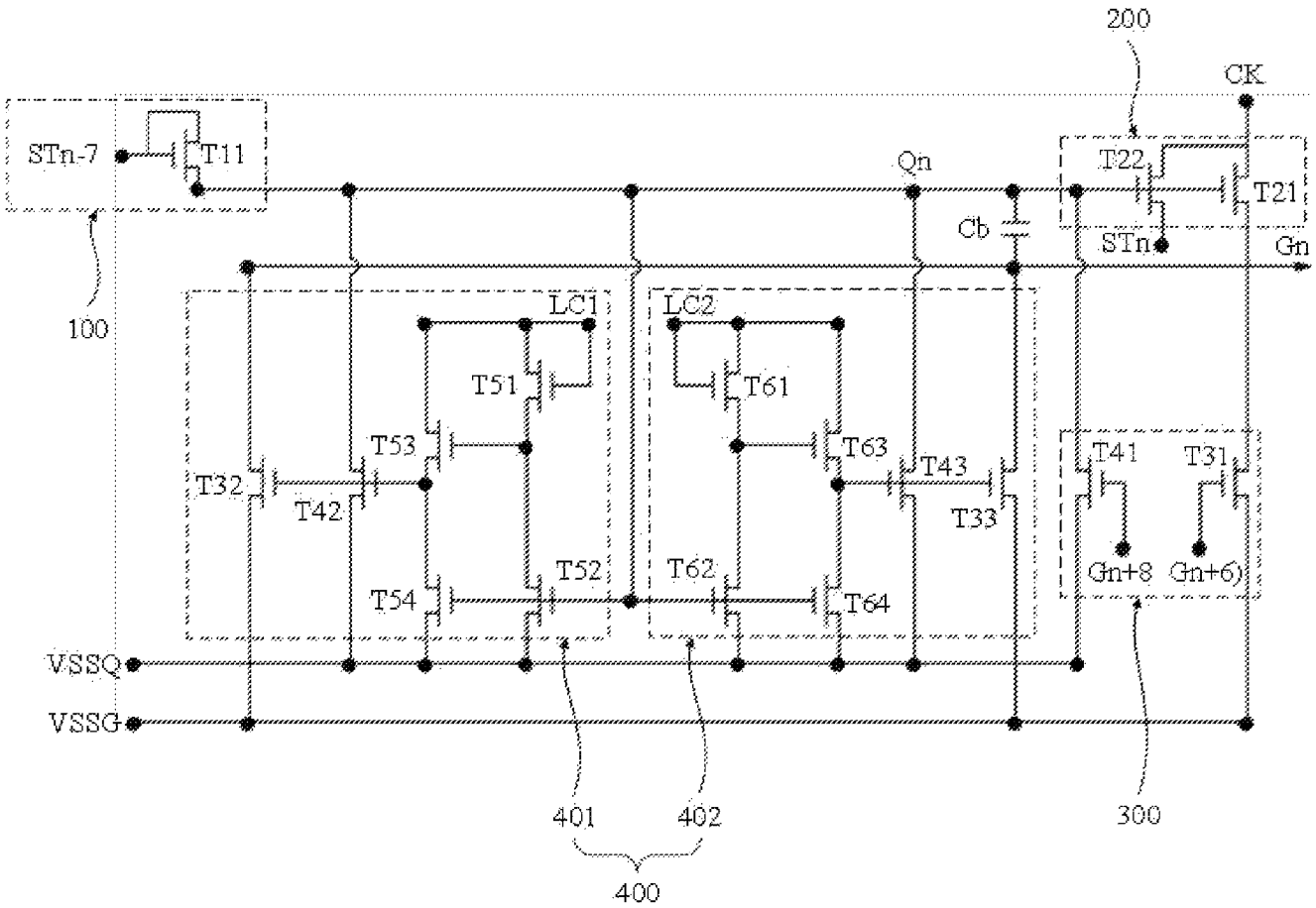
FIG. 1 is a structural diagram of a GOA unit according to the present disclosure.

A description is provided with reference to FIG. 1. The present disclosure provides a GOA device comprising at least two GOA units in cascade. An n-th GOA unit is configured to output a gate drive signal to an n-th horizontal scan line. The n-th GOA unit comprises a pull-up control circuit 100, a bootstrap capacitor Cb, a pull-up unit 200, a pull-down unit 300 and a pull-down hold unit 400.

The pull-up control circuit 100 receives a start signal of an n−7-th stage during a first stage, so that a control node (Qn) of the n-th GOA unit is pulled up to a first high potential and the bootstrap capacitor Cb is charged.

The bootstrap capacitor Cb maintains the control node (Qn) of the n-th GOA unit at the first high potential during a second stage.

The pull-up unit 200 outputs the gate drive signal to a gate signal terminal (Gn) of the n-th GOA unit according to a clock signal and the first high potential of the control node (Qn) of the n-th GOA unit.

During a third stage, the pull-down unit 300 pulls a potential of the control node (Qn) of the n-th GOA unit to a first DC low level, and pulls a potential of the gate signal terminal (Gn) of the n-th GOA unit to a second DC low level.

During a fourth stage, the pull-down hold unit 400 maintains the control node (Qn) of the n-th GOA unit at the first DC low level, and maintains the potential of the gate signal terminal (Gn) of the n-th GOA unit at the second DC low level.

In one cycle, a duration of the clock signal at a high level is longer than a duration of the clock signal at a low level.

The present disclosure connects an input terminal of the pull-up control circuit 100 to the start signal of the n−7-th stage, the control node (Qn) of the n-th GOA unit is thus pulled up to the first high potential and the bootstrap capacitor Cb is charged. The control node (Qn) is charged 7 stages in advance, which resolves the technical problem of insufficient charging of the high-resolution high-refresh rate display panel in the related art.

The technical scheme of the present disclosure is described with reference to the embodiments.

A description is provided with reference to FIG. 1. The pull-up control circuit 100 receives the start signal of the n−7-th stage during the first stage, so that the control node (Qn) of the n-th GOA unit is pulled up to the first high potential and the bootstrap capacitor Cb is charged.

The pull-up control circuit 100 is connected to a stage signal terminal (STn−7) of the n−7-th GOA unit and the control node (Qn) of the n-th GOA unit. The start signal comes from the stage signal terminal (STn−7) of the n−7-th GOA unit.

During the first stage, the pull-up control circuit 100 receives the start signal from the stage signal terminal (STn−7) of the n−7-th GOA unit, and allows the control node (Qn) of the n-th GOA unit to be at the first high potential according to the received start signal of the stage signal terminal (STn−7) of the n−7-th GOA unit.

The pull-up control circuit 100 comprises an eleventh thin film transistor (eleventh TFT, T11). A gate and a source of the eleventh TFT (T11) are connected to the stage signal terminal (STn−7) of the n−7-th GOA unit. A drain of the eleventh TFT (T11) is connected to the control node (Qn) of the n-th GOA unit. The eleventh TFT (T11) receives the start signal from the stage signal terminal (STn−7) of the n−7-th GOA unit to turn on the eleventh TFT (T11). The drain of the eleventh TFT (T11) transmits the start signal from the stage signal terminal (STn−7) of the n−7-th GOA unit to the control node (Qn) of the n-th GOA unit, and allows the control node (Qn) of the n-th GOA unit to be at the first high potential.

A description is provided with reference to FIG. 1. The bootstrap capacitor Cb maintains the control node (Qn) of the n-th GOA unit at the first high potential during the second stage.

The bootstrap capacitor Cb is connected to the control node (Qn) of the n-th GOA unit, the gate signal terminal (Gn) of the n-th GOA unit, the pull-down hold unit 400, and the pull-up unit 200.

A first terminal of the bootstrap capacitor Cb is connected to the control node (Qn) of the n-th GOA unit and the pull-up unit 200. A second terminal of the bootstrap capacitor Cb is connected to the gate signal terminal (Gn) of the n-th GOA unit and the pull-down hold unit 400.

During the second stage, the eleventh TFT (T11) is turned off, and the start signal from the stage signal terminal (STn−7) of the n−7-th GOA unit can not maintain the control node (Qn) of the n-th GOA unit at the first high potential. At this time, the bootstrap capacitor Cb continues maintaining the control node (Qn) of the n-th GOA unit at the first high potential.

The pull-up unit 200 outputs the gate drive signal to the gate signal terminal (Gn) of the n-th GOA unit according to the clock signal and the first high potential of the control node (Qn) of the n-th GOA unit.

The pull-up unit 200 is connected to the control node (Qn) of the n-th GOA unit, a clock signal terminal (CK), a stage signal terminal (STn) of the n-th GOA unit, and the gate signal terminal (Gn) of an n-th stage.

The clock signal terminal (CK) is configured to provide the clock signal.

Figure 2:
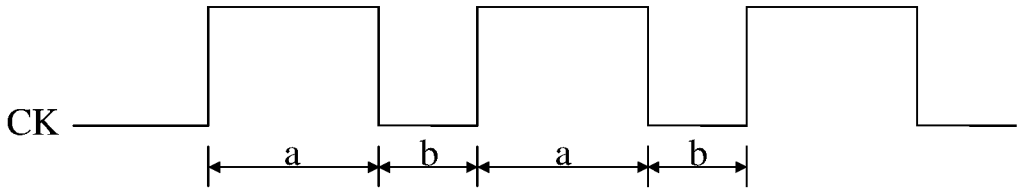
FIG. 2 is a timing diagram of clock signals of a GOA unit according to the present disclosure.

A description is provided with reference to FIG. 2. In one cycle, a duration a of the clock signal at the high level is longer than a duration b of the clock signal at the low level. A duty ratio of the clock signal may be greater than 50%.

As compared with the related art, this present disclosure extends a duration during which the clock signal is at the high level to increase a working time of the second stage. That is, the present disclosure extends a duration in which the control node (Qn) of the n-th GOA unit is at the first high potential, to further increase a charging time of the control node (Qn) of the n-th GOA unit.

The duty ratio of the clock signal is greater than 50% and less than 60%.

The potential of the control node (Qn) of the n-th GOA unit is configured to control thin film transistors in the pull-up unit 200 to turn on and turn off.

The pull-up unit 200 comprises a twenty-first TFT (T21) and a twenty-second TFT (T22).

A gate of the twenty-first TFT (T21) is connected to the control node (Qn) of the n-th GOA unit. A source of the twenty-first TFT (T21) is connected to the clock signal terminal (CK). A drain of the twenty-first TFT (T21) is connected to the gate signal terminal (Gn) of the n-th stage.

A gate of the twenty-second TFT (T22) is connected to the control node (Qn) of the n-th GOA unit. A source of the twenty-second TFT (T22) is connected to the clock signal terminal (CK). A drain of the twenty-second TFT (T22) is connected to the stage signal terminal (STn) of the n-th GOA unit.

The first high potential of the control node (Qn) of the n-th GOA unit turns on the twenty-first TFT (T21) and the twenty-second TFT (T22). The drain of the twenty-first TFT (T21) is connected to the gate signal terminal (Gn) of the n-th stage to output the gate drive signal to the n-th scan line. The drain of the twenty-second TFT (T22) is connected to the stage signal terminal (STn) of the n-th GOA unit to output another start signal so as to control a next stage GOA unit to turn on and turn off.

During the third stage, the pull-down unit 300 pulls the potential of the control node (Qn) of the n-th GOA unit to the first DC low level, and pulls the potential of the gate signal terminal (Gn) of the n-th GOA unit to the second DC low level.

The pull-down unit 300 is connected to the control node (Qn) of the n-th GOA unit, the gate signal terminal (Gn) of the n-th GOA unit, a gate signal terminal (Gn+6) of an n+6-th GOA unit, a gate signal terminal (Gn+8) of an n+8-th GOA unit, a first DC low level terminal (VSSQ), and a second DC low level terminal (VSSG).

The first DC low level terminal (VSSQ) provides the first DC low level, and the second DC low level terminal (VSSG) provides the second DC low level.

The third stage starts when the gate signal terminal (Gn+6) of the n+6-th stage GOA unit or/and the gate signal terminal (Gn+8) of the n+8-th stage GOA unit is at the high level.

The pull-down unit 300 comprises a thirty-first TFT (T31) and a forty-first TFT (T41).

A source of the thirty-first TFT (T31) is connected to the gate signal terminal (Gn) of the n-th stage GOA unit. A source of the forty-first TFT (T41) is connected to the control node (Qn) of the n-th GOA unit.

The thirty-first TFT (T31) is connected to the second DC low level terminal (VSSG), and a drain of the forty-first TFT (T41) is connected to the first DC low level terminal (VSSQ).

A gate of the thirty-first TFT (T31) is connected to the gate signal terminal (Gn+6) of the n+6-th GOA unit, and a gate of the forty-first TFT (T41) is connected to the gate signal terminal (Gn+8) of the n+8-th GOA unit.

When the gate signal terminal (Gn+6) of the n+6-th GOA unit and the gate signal terminal (Gn+8) of the n+8-th GOA unit are at a high potential, the thirty-first TFT (T31) and the forty-first TFT (T41) are turned on. The control node (Qn) of the n-th GOA unit is pulled down to the first DC low level. The gate signal terminal (Gn) of the n-th GOA unit is pulled down to the second DC low level.

During the forth stage, the pull-down hold unit 400 maintains the control node (Qn) of the n-th GOA unit at the first DC low level, and maintains the potential of the gate signal terminal (Gn) of the n-th GOA unit at the second DC low level.

In the present embodiment, the pull-down hold unit 400 comprises a first pull-down hold sub-unit 401 and a second pull-down hold sub-unit 402. The first pull-down hold sub-unit 401 is connected to a first high-voltage signal, the control node (Qn) of the n-th GOA unit, the gate signal terminal (Gn) of the n-th GOA unit, the first DC low level terminal (VSSQ), and the second DC low level terminal (VSSG). The second pull-down hold sub-unit 402 is connected to a second high-voltage signal, the control node (Qn) of the n-th GOA unit, the gate signal terminal (Gn) of the n-th GOA unit, the first DC low level terminal (VSSQ), and the second DC low level terminal (VSSG).

The first high-voltage signal is sent from a first high-voltage DC signal terminal LC1, and the second high-voltage signal is sent from a second high-voltage DC signal terminal LC2.

The first high-voltage signal and the second high-voltage signal are 200 times a frame period. The first high-voltage signal and the second high-voltage signal are low frequency signals having a duty ratio of 50%, and a phase of the first high-voltage signal differs from a phase of the second high-voltage signal by 180 degrees.

The first pull-down hold sub-unit 401 comprises a fifty-first TFT (T51), a fifty-second TFT (T52), a fifty-third TFT (T53), a fifty-fourth TFT (T54), a forty-second TFT (T42) and a thirty-second TFT (T32).

A gate and a drain of the fifty-first TFT (T51) are connected to the first high-voltage DC signal terminal LC1. A source of the fifty-first TFT (T51) is electrically connected to a drain of the fifty-second TFT (T52) and a gate of the fifty-third TFT (T53).

A gate of the fifty-second TFT (T52) is electrically connected to an output terminal of the pull-up control circuit 100. A source of the fifty-second TFT (T52) is electrically connected to the first DC low level terminal (VSSQ).

A drain of the fifty-third TFT (T53) is connected to the first high-voltage DC signal terminal LC1. A source of the fifty-third TFT (T53) is electrically connected to a drain of the fifty-fourth TFT (T54), a gate of the forty-second TFT (T42), and a gate of the thirty-second TFT (T32).

A gate of the fifty-fourth TFT (TM) is electrically connected to the output terminal of the pull-up control circuit 100. A source of the fifty-fourth TFT (TM) is electrically connected to the first DC low level terminal (VSSQ).

A source of the forty-second TFT (T42) is electrically connected to the first DC low level terminal (VSSQ). A drain of the forty-second TFT (T42) is electrically connected to the output terminal of the pull-up control circuit 100.

A source of the thirty-second TFT (T32) is electrically connected to the second DC low level terminal (VSSG). A drain of the thirty-second TFT (T32) is electrically connected to an output terminal of a scan signal of this stage.

The second pull-down hold sub-unit 402 comprises a sixty-first TFT (T61), a sixty-second TFT (T62), a sixty-third TFT (T63), a sixty-fourth TFT (T64), a forty-third TFT (T43) and a thirty-third TFT (T33).

A gate and a drain of the sixty-first TFT (T61) are connected to the second high-voltage DC signal terminal LC2. A source of the sixty-first TFT (T61) is electrically connected to a drain of the sixty-second TFT (T62) and a gate of the sixty-third TFT (T63).

A gate of the sixty-second TFT (T62) is electrically connected to the output terminal of the pull-up control circuit 100. A source of the sixty-second TFT (T62) is electrically connected to the first DC low level terminal (VSSQ).

A drain of the sixty-third TFT (T63) is connected to the second high-voltage DC signal terminal LC2. A source of the sixty-third TFT (T63) is electrically connected to a drain of the sixty-fourth TFT (T64), a gate of the forty-third TFT (T43), and a gate of the thirty-third TFT (T33).

A gate of the sixty-fourth TFT (T64) is electrically connected to the output terminal of the pull-up control circuit 100. A source of the sixty-fourth TFT (T64) is electrically connected to the first DC low level terminal (VSSQ).

A source of the forty-third TFT (T43) is electrically connected to the first DC low level terminal (VSSQ). A drain of the forty-third TFT (T43) is electrically connected to the output terminal of the pull-up control circuit 100.

A source of the thirty-third TFT (T33) is electrically connected to the second DC low level terminal (VSSG). A drain of the thirty-third TFT (T33) is electrically connected to the output terminal of the scan signal of this stage.

The present disclosure connects the input terminal of the pull-up control circuit 100 to the start signal of the n−7-th stage, the control node (Qn) of the n-th GOA unit is thus pulled up to the first high potential and the bootstrap capacitor Cb is charged. The control node (Qn) is charged 7 stages in advance, which resolves the technical problem of insufficient charging of the high-resolution high-refresh rate display panel in the related art.

The present disclosure further provides a gate drive circuit comprising the above GOA device. Since the working principle of the gate drive circuit is the same as or similar to the working principle of the above GOA device, a description is not provided here.

The present disclosure provides a GOA device and a gate drive circuit. The GOA device comprises at least two GOA units in cascade. The GOA unit comprises a pull-up control circuit, a bootstrap capacitor, a pull-up unit, a pull-down unit and a pull-down hold unit. The present disclosure connects the input terminal of the pull-up control circuit to the start signal of the n−7-th stage, the control node (Qn) of the n-th GOA unit is thus pulled up to the first high potential and the bootstrap capacitor is charged. The control node (Qn) is charged 7 stages in advance, which resolves the technical problem of insufficient charging of the high-resolution high-refresh rate display panel in the related art.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A gate drive on array (GOA) device comprising at least two GOA units in cascade, an n-th GOA unit being configured to output a gate drive signal to an n-th horizontal scan line, wherein the n-th GOA unit comprises a pull-up control circuit, a bootstrap capacitor, a pull-up unit, a pull-down unit and a pull-down hold unit;

the pull-up control circuit receiving a start signal of an n−7-th stage during a first stage, so that a control node (Qn) of the n-th GOA unit is pulled up to a first high potential and the bootstrap capacitor is charged;

the bootstrap capacitor maintaining the control node (Qn) of the n-th GOA unit at the first high potential during a second stage;

the pull-up unit outputting the gate drive signal to a gate signal terminal (Gn) of the n-th GOA unit according to a clock signal and the first high potential of the control node (Qn) of the n-th GOA unit;

the pull-down unit pulling a potential of the control node (Qn) of the n-th GOA unit to a first DC low level, and pulling a potential of the gate signal terminal (Gn) of the n-th GOA unit to a second DC low level during a third stage; and the pull-down hold unit maintaining the control node (Qn) of the n-th GOA unit at the first DC low level, and maintaining the potential of the gate signal terminal (Gn) of the n-th GOA unit at the second DC low level during a fourth stage;

wherein a duration of the clock signal at a high level is longer than a duration of the clock signal at a low level.

2. The GOA device as claimed in claim 1, wherein the pull-up control circuit is connected to a stage signal terminal (STn−7) of the n−7-th GOA unit and the control node (Qn) of the n-th GOA unit;

the pull-up control circuit receiving the start signal from the stage signal terminal (STn−7) of the n−7-th GOA unit, and allowing the control node (Qn) of the n-th GOA unit to be at the first high potential according to the received start signal of the stage signal terminal (STn−7) of the n−7-th GOA unit during the first stage.

3. The GOA device as claimed in claim 2, wherein the pull-up control circuit comprises a first TFT; a gate and a source of the first TFT (T11) are connected to the stage signal terminal (STn−7) of the n−7-th GOA unit, and a drain of the first TFT (T11) is connected to the control node (Qn) of the n-th GOA unit.

4. The GOA device as claimed in claim 1, wherein the bootstrap capacitor is connected to the control node (Qn) of the n-th GOA unit, the gate signal terminal (Gn) of the n-th GOA unit, the pull-down hold unit, and the pull-up unit;

a first terminal of the bootstrap capacitor is connected to the control node (Qn) of the n-th GOA unit and the pull-up unit, a second terminal of the bootstrap capacitor is connected to the gate signal terminal (Gn) of the n-th GOA unit and the pull-down hold unit.

5. The GOA device as claimed in claim 1, wherein the pull-up unit is connected to the control node (Qn) of the n-th GOA unit, a clock signal terminal (CK), a stage signal terminal (STn) of the n-th GOA unit and the gate signal terminal (Gn) of the n-th stage;

the clock signal terminal (CK) is configured to provide the clock signal;

the potential of the control node (Qn) of the n-th GOA unit is configured to control thin film transistors in the pull-up unit to turn on and turn off.

6. The GOA device as claimed in claim 5, wherein the pull-up unit comprises a second TFT (T21) and a third TFT (T22); a gate of the second TFT (T21) is connected to the control node (Qn) of the n-th GOA unit, a source of the second TFT (T21) is connected to the clock signal terminal (CK), a drain of the second TFT (T21) is connected to the gate signal terminal (Gn) of the n-th stage; a gate of the third TFT (T22) is connected to the control node (Qn) of the n-th GOA unit, a source of the third TFT (T22) is connected to the clock signal terminal (CK), a drain of the third TFT (T22) is connected to the stage signal terminal (STn) of the n-th GOA unit.

7. The GOA device as claimed in claim 1, wherein the pull-down unit is connected to the control node (Qn) of the n-th GOA unit, the gate signal terminal (Gn) of the n-th GOA unit, a gate signal terminal (Gn+6) of an n+6-th GOA unit, a gate signal terminal (Gn+8) of an n+8-th GOA unit, a first DC low level terminal (VSSQ), and a second DC low level terminal (VSSG);

the first DC low level terminal (VSSQ) providing the first DC low level, and the second DC low level terminal (VSSG) providing the second DC low level;

the third stage starting when the gate signal terminal (Gn+6) of the n+6-th stage GOA unit or/and the gate signal terminal (Gn+8) of the n+8-th stage GOA unit is at the high level.

8. The GOA device as claimed in claim 7, wherein the pull-down unit comprises a fourth TFT (T31) and a fifth TFT (T41); a source of the fourth TFT (T31) is connected to the gate signal terminal (Gn) of the n-th stage GOA unit, a source of the fifth TFT (T41) is connected to the control node (Qn) of the n-th GOA unit; a drain of the fourth TFT (T31) is connected to the second DC low level terminal (VSSG), and a drain of the fifth TFT (T41) is connected to the first DC low level terminal (VSSQ); a gate of the fourth TFT (T31) is connected to the gate signal terminal (Gn+6) of the n+6-th GOA unit, and a gate of the fifth TFT (T41) is connected to the gate signal terminal (Gn+8) of the n+8-th GOA unit.

9. The GOA device as claimed in claim 1, wherein the pull-down hold unit comprises a first pull-down hold sub-unit and a second pull-down hold sub-unit;

the first pull-down hold sub-unit is connected to a first high-voltage signal, the control node (Qn) of the n-th GOA unit, the gate signal terminal (Gn) of the n-th GOA unit, a first DC low level terminal (VSSQ), and a second DC low level terminal (VSSG);

the second pull-down hold sub-unit is connected to a second high-voltage signal, the control node (Qn) of the n-th GOA unit, the gate signal terminal (Gn) of the n-th GOA unit, the first DC low level terminal (VSSQ), and the second DC low level terminal (VSSG).

10. A gate drive circuit comprising a gate drive on array (GOA) device, the GOA device comprising at least two GOA units in cascade, an n-th GOA unit being configured to output a gate drive signal to an n-th horizontal scan line, wherein the n-th GOA unit comprises a pull-up control circuit, a bootstrap capacitor, a pull-up unit, a pull-down unit and a pull-down hold unit;

the pull-up control circuit receiving a start signal of an n−7-th stage during a first stage, so that a control node (Qn) of the n-th GOA unit is pulled up to a first high potential and the bootstrap capacitor is charged;

the bootstrap capacitor maintaining the control node (Qn) of the n-th GOA unit at the first high potential during a second stage;

the pull-up unit outputting the gate drive signal to a gate signal terminal (Gn) of the n-th GOA unit according to a clock signal and the first high potential of the control node (Qn) of the n-th GOA unit;

the pull-down unit pulling a potential of the control node (Qn) of the n-th GOA unit to a first DC low level, and pulling a potential of the gate signal terminal (Gn) of the n-th GOA unit to a second DC low level during a third stage; and the pull-down hold unit maintaining the control node (Qn) of the n-th GOA unit at the first DC low level, and maintaining the potential of the gate signal terminal (Gn) of the n-th GOA unit at the second DC low level during a fourth stage;

wherein a duration of the clock signal at a high level is longer than a duration of the clock signal at a low level.

11. The gate drive circuit as claimed in claim 10, wherein the pull-up control circuit is connected to a stage signal terminal (STn−7) of the n−7-th GOA unit and the control node (Qn) of the n-th GOA unit;

the pull-up control circuit receiving the start signal from the stage signal terminal (STn−7) of the n−7-th GOA unit, and allowing the control node (Qn) of the n-th GOA unit to be at the first high potential according to the received start signal of the stage signal terminal (STn−7) of the n−7-th GOA unit during the first stage.

12. The gate drive circuit as claimed in claim 11, wherein the pull-up control circuit comprises a first TFT; a gate and a source of the first TFT (T11) are connected to the stage signal terminal (STn−7) of the n−7-th GOA unit, and a drain of the first TFT (T11) is connected to the control node (Qn) of the n-th GOA unit.

13. The gate drive circuit as claimed in claim 10, wherein the bootstrap capacitor is connected to the control node (Qn) of the n-th GOA unit, the gate signal terminal (Gn) of the n-th GOA unit, the pull-down hold unit, and the pull-up unit;

a first terminal of the bootstrap capacitor is connected to the control node (Qn) of the n-th GOA unit and the pull-up unit, a second terminal of the bootstrap capacitor is connected to the gate signal terminal (Gn) of the n-th GOA unit and the pull-down hold unit.

14. The gate drive circuit as claimed in claim 10, wherein the pull-up unit is connected to the control node (Qn) of the n-th GOA unit, a clock signal terminal (CK), a stage signal terminal (STn) of the n-th GOA unit and the gate signal terminal (Gn) of the n-th stage;

the clock signal terminal (CK) is configured to provide the clock signal;

the potential of the control node (Qn) of the n-th GOA unit is configured to control thin film transistors in the pull-up unit to turn on and turn off.

15. The gate drive circuit as claimed in claim 14, wherein the pull-up unit comprises a second TFT (T21) and a third TFT (T22); a gate of the second TFT (T21) is connected to the control node (Qn) of the n-th GOA unit, a source of the second TFT (T21) is connected to the clock signal terminal (CK), a drain of the second TFT (T21) is connected to the gate signal terminal (Gn) of the n-th stage; a gate of the third TFT (T22) is connected to the control node (Qn) of the n-th GOA unit, a source of the third TFT (T22) is connected to the clock signal terminal (CK), a drain of the third TFT (T22) is connected to the stage signal terminal (STn) of the n-th GOA unit.

16. The gate drive circuit as claimed in claim 10, wherein the pull-down unit is connected to the control node (Qn) of the n-th GOA unit, the gate signal terminal (Gn) of the n-th GOA unit, a gate signal terminal (Gn+6) of an n+6-th GOA unit, a gate signal terminal (Gn+8) of an n+8-th GOA unit, a first DC low level terminal (VSSQ), and a second DC low level terminal (VSSG);

the first DC low level terminal (VSSQ) providing the first DC low level, and the second DC low level terminal (VSSG) providing the second DC low level;

the third stage starting when the gate signal terminal (Gn+6) of the n+6-th stage GOA unit or/and the gate signal terminal (Gn+8) of the n+8-th stage GOA unit is at the high level.

17. The gate drive circuit as claimed in claim 16, wherein the pull-down unit comprises a fourth TFT (T31) and a fifth TFT (T41); a source of the fourth TFT (T31) is connected to the gate signal terminal (Gn) of the n-th stage GOA unit, a source of the fifth TFT (T41) is connected to the control node (Qn) of the n-th GOA unit; a drain of the fourth TFT (T31) is connected to the second DC low level terminal (VSSG), and a drain of the fifth TFT (T41) is connected to the first DC low level terminal (VSSQ); a gate of the fourth TFT (T31) is connected to the gate signal terminal (Gn+6) of the n+6-th GOA unit, and a gate of the fifth TFT (T41) is connected to the gate signal terminal (Gn+8) of the n+8-th GOA unit.

18. The gate drive circuit as claimed in claim 10, wherein the pull-down hold unit comprises a first pull-down hold sub-unit and a second pull-down hold sub-unit;

the first pull-down hold sub-unit is connected to a first high-voltage signal, the control node (Qn) of the n-th GOA unit, the gate signal terminal (Gn) of the n-th GOA unit, a first DC low level terminal (VSSQ), and a second DC low level terminal (VSSG);

the second pull-down hold sub-unit is connected to a second high-voltage signal, the control node (Qn) of the n-th GOA unit, the gate signal terminal (Gn) of the n-th GOA unit, the first DC low level terminal (VSSQ), and the second DC low level terminal (VSSG).

* * * * *